US006079455A

United States Patent [19]

Speich et al.

[11] Patent Number: 6,079,455

[45] Date of Patent: Jun. 27, 2000

[54] DEVICE FOR CONTROLLING THE TRANSVERSE MOVEMENT OF AT LEAST ONE THREAD IN A TEXTILE MACHINE

[75] Inventors: Francisco Speich, Gipf-Oberfrick; Giuseppe Mele, Buchs; Gerard Durville, Gipf-Oberfrick, all of Switzerland

[73] Assignee: Textilma AG, Hergiswil, Switzerland

[21] Appl. No.: 09/308,895

[22] PCT Filed: Oct. 24, 1997

[86] PCT No.: PCT/CH97/00404

§ 371 Date: May 26, 1999

§ 102(e) Date: May 26, 1999

[87] PCT Pub. No.: WO98/24955

PCT Pub. Date: Jun. 11, 1998

[30] Foreign Application Priority Data

Dec. 3, 1996 [DE] Germany ..... 296 21 008 U

[51] Int. Cl.[7] ..... D03C 13/00

[52] U.S. Cl. ..... 139/455; 139/55.1; 139/35

[58] Field of Search ..... 139/455, 5, 35, 139/48, 55.1

[56] References Cited

U.S. PATENT DOCUMENTS

| | | | |
|---|---|---|---|
| 3,867,966 | 2/1975 | Wieland | 139/55 |

FOREIGN PATENT DOCUMENTS

| | | |
|---|---|---|
| 0 304 985 | 3/1989 | European Pat. Off. . |
| 0 353 005 | 1/1990 | European Pat. Off. . |
| 39 02 792 | of 0000 | Germany . |
| 22 03 925 | 8/1973 | Germany . |
| 27 46 094 | 4/1979 | Germany . |
| 31 30 461 | 2/1983 | Germany . |
| 33 01 931 | 7/1984 | Germany . |
| 296 21 008 U | 3/1997 | Germany . |

OTHER PUBLICATIONS

H. Haase: "Die Zukunft de Jacquardmaschine" Textil–Praxis International, Bd.30, Nr.3, März 1976 S.287–291, XP002052007, siehe S.250; Abb. 15 Mühlmann, Rainer, Rudolff, Erich: "Einsatz viskoelastischer Werkstoffe als Rückzugsfedern in Jacquardwebmaschinen", In: Melliand Textilberichte Feb. 1991, S.103–108.

*Primary Examiner*—John J. Calvert
*Assistant Examiner*—Robert H. Muromoto, Jr.
*Attorney, Agent, or Firm*—McCormick, Paulding & Huber LLP

[57] ABSTRACT

In a textile machine, a device for controlling the transverse movement of a thread, such as a warp thread in a weaving machine, comprises a dragging element (2) for dragging a thread (4) moving in a transverse direction, whereby said dragging element (2) is attached on both sides to a frame (10) by means of springs (6,8). The device forms a system that oscillates freely at its natural frequency. Arresting devices (12,14) can adjustably and temporarily hold the dragging element in the extreme positions.

17 Claims, 5 Drawing Sheets

Amplitude
ts
13b
13c
13
t

Hub
13
13d
13e
15
ts1
ts2
2×ts1
2×ts2
1 Maschinenumdrehung
Maschinenstellung in Grad
16
6
12
2
4
14
8
10

12c
42
14c

S
N
N
S
2c
Hub/
Amplitude

N
S
S
N
N
S
S
N 38
40
N
S
S
N
N
S
S
N
36
32
34
2b
14b
12b 12a
30
24
20
22
28
26
14a
18
S
N
2a

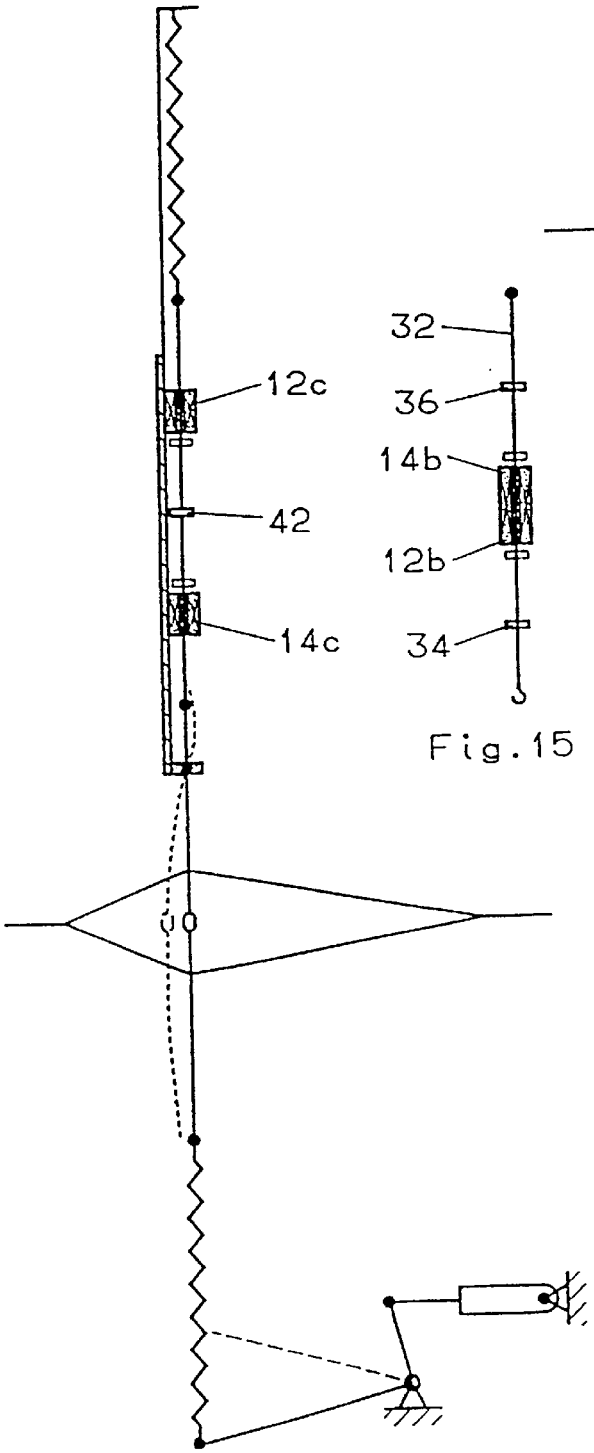
Fig.14
Fig.15
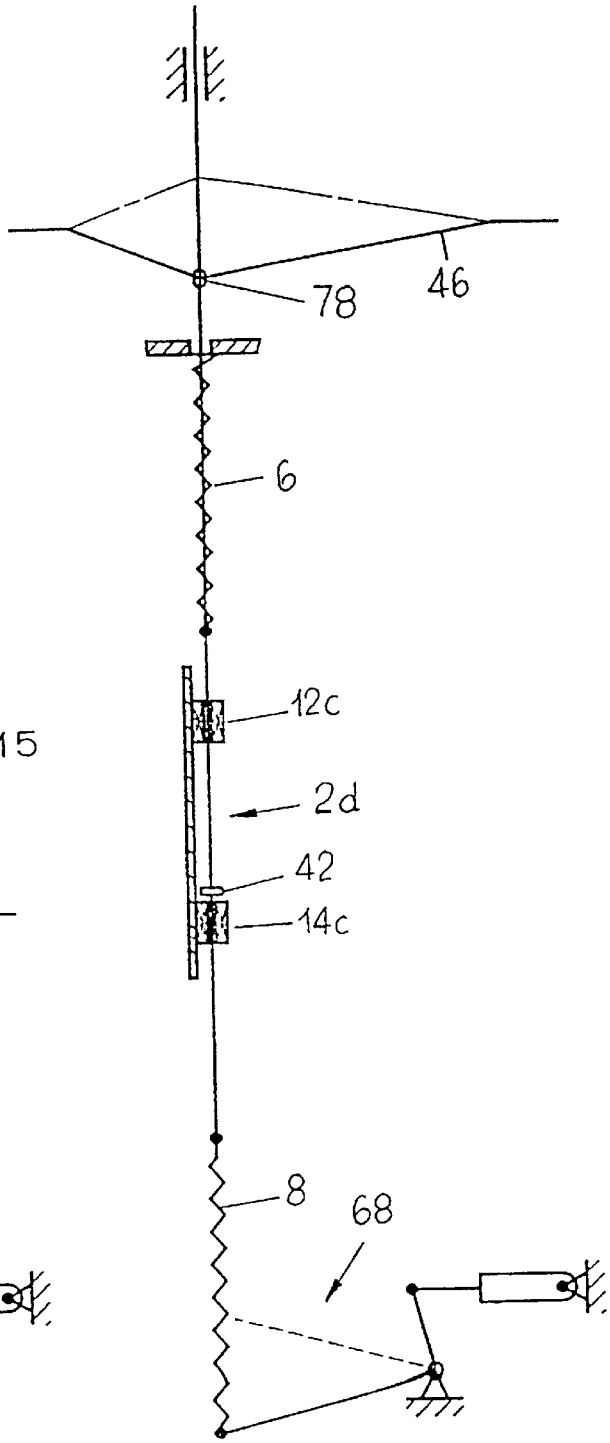
Fig.16

DEVICE FOR CONTROLLING THE TRANSVERSE MOVEMENT OF AT LEAST ONE THREAD IN A TEXTILE MACHINE

BACKGROUND OF THE INVENTION

1. Technical Subject

The innovation disclosed hereunder consists in a device for controlling at least one thread in a textile machine, especially a warp thread in a weaving loom.

2. State of the Art

Numerous devices for the controlling of the transverse movement of a thread in a textile machine, especially a warp thread are well known to those learned in the art. The threads are threaded through and guided by the eyes of heddles which are moved, according to a determined programme and via connecting structures, by different driving devices such as jacquard machines, heddle looms, treadle looms and colour control units. These machines and devices involve large numbers of different components, which unavoidably exerts a negative influence on the speed of the thread control mechanism. The already disclosed systems are additionally characterised by the following significant disadvantages: high forces of gravity, significant wear and tear, great emission of noise, significant vibration, enormous space requirements, high production and operating costs, poor ergonomic characteristics, etc.

So far, many attempts were made to eliminate these disadvantages.

Under U.S. Pat. No. 3,867,966, for example, a device of the type mentioned above was disclosed which attempts to eliminate the disadvantages described by way of introduction. This device comprises a dragging element inserted between two springs, which serves to drag at least one thread. An arresting device controlled by means of a control unit serves to temporarily arrest the dragging element in at least one extreme position. The dragging element is designed in the form of a heddle, which comprises a ribbon section, which contains a conductor and is located between two isolators. This ribbon section runs over a roller, which can be electrically activated. As soon as electrical current is fed to the roller or to the ribbon section, respectively, friction between the roller and the ribbon section increases so that the ribbon section can be dragged by the roller and moved to an extreme position where magnetic arresting devices are located which arrest the heddle as long as the electrical arresting devices are activated. A considerable disadvantage of this type of device, however, consists in the fact that the heddle must be equipped with a ribbon section, which contains electrically conducting elements and that dragging is effected by friction only. This causes high wear between the roller and the ribbon section. Additionally, even friction between the ribbon section and the roller cannot be guaranteed, because friction is constantly changing due to both wear and the accumulation of dirt.

SUMMARY OF THE INVENTION

The purpose of the invention disclosed hereunder consists in further improving a device of the type mentioned above.

The invention's characterising features employ springs and a dragging element. As the springs and the dragging element are designed as a system that oscillates freely at its natural frequency, the system, once activated, continues to oscillate independently, the only further requirement consisting in supplying a sufficient amount of energy to make up for system-related losses of energy, e.g. due to friction, etc. This energy supply, however, can be effected by extremely simple means.

Thus an extremely simple and economically viable device for controlling the transverse movement of at least one thread of a textile machine can be designed. Additionally, the design stands out for good wear-resistance and requires only a small energy supply to keep it operating. The arresting device allows selective control immediately at the thread-dragging element. With only few components and good wear-resistance, the device allows significantly higher drive speeds.

Several different advantageous designs are available.

One design allows programmed controlling of the device by very simple means.

In one design which is particularly advantageous an additional individual control can be achieved, for example, by keeping one shed open. It is, in particular, possible to adapt the oscillating system to the rotational speed of the machine connected thereto, in particular a weaving loom. The arresting device can be designed in a variety of different ways. It is, for example, possible to allocate a mechanically, pneumatically or electrically operated arresting pin to the dragging element. A particularly simple and low-wear design employs an arresting device with a releasable magnet device. The magnetic device can, for example, consist of a permanently magnetic device, which interacts with a ferromagnetic component and can be released by mechanical or pneumatic means. However, a design employing a permanent magnet influenced by an electromagnet is more advantageous.

To keep the oscillating system moving, energy must be supplied. This can be effected in different ways. In one design which is particularly recommended, the arresting device at the same time serves to supply the required energy as the dragging element is always lifted to the same height. A more active way of supplying energy is allowed by a piston and cylinder. In this case, a hydraulic fluid supplied to the piston and cylinder design can serve as a means to supply energy. In a particularly simple solution, on the other hand, the energy supply can be designed in such a way that it exceeds the amount of energy required to keep the oscillating system moving, thus allowing additional control effects to be achieved.

The device should preferably be equipped with a resetting device which temporarily renders the springs of the oscillating system ineffective. Such a resetting device is especially recommended for applications where the thread dragging elements must be moved to a centre shed position for adjusting and/or repair work. From this position, the device cannot start itself as the spring forces offset each other. Thus, the thread dragging elements must be moved to the corresponding arresting devices in one of the extreme positions by means of the resetting device. From these extreme positions, the thread dragging elements can then, due to the corresponding spring tension, be released to oscillate. The resetting device can, for example, act directly on the thread-dragging element or relieve the springs on one side.

The thread can be connected to the dragging element in different ways. In the simplest design the thread-dragging element is located between the springs and designed in the form of an eye. However, the unit to which the thread is connected can be located outside the oscillating system by means of an extension of the dragging element. The oscillating system can be used to control a single thread or several threads at the same time. In the latter case the dragging element can be designed in the form of a heddle frame.

BRIEF DESCRIPTION OF THE DRAWINGS

Examples for the design of the invention are described below on the basis of the following drawings showing the structures indicated below:

FIG. 14 shows a schematic lateral view of a weaving loom with arresting devices according to FIG. 11.

FIG. 15 shows the weaving loom illustrated in FIG. 14 with an arresting device according to FIG. 9 and FIG. 10.

FIG. 16 shows a schematic lateral view of a weaving loom with another modified version of the device disclosed hereunder.

DESCRIPTION OF THE PREFERRED EMBODIMENTS

Figures 1, 2, 3, 4:
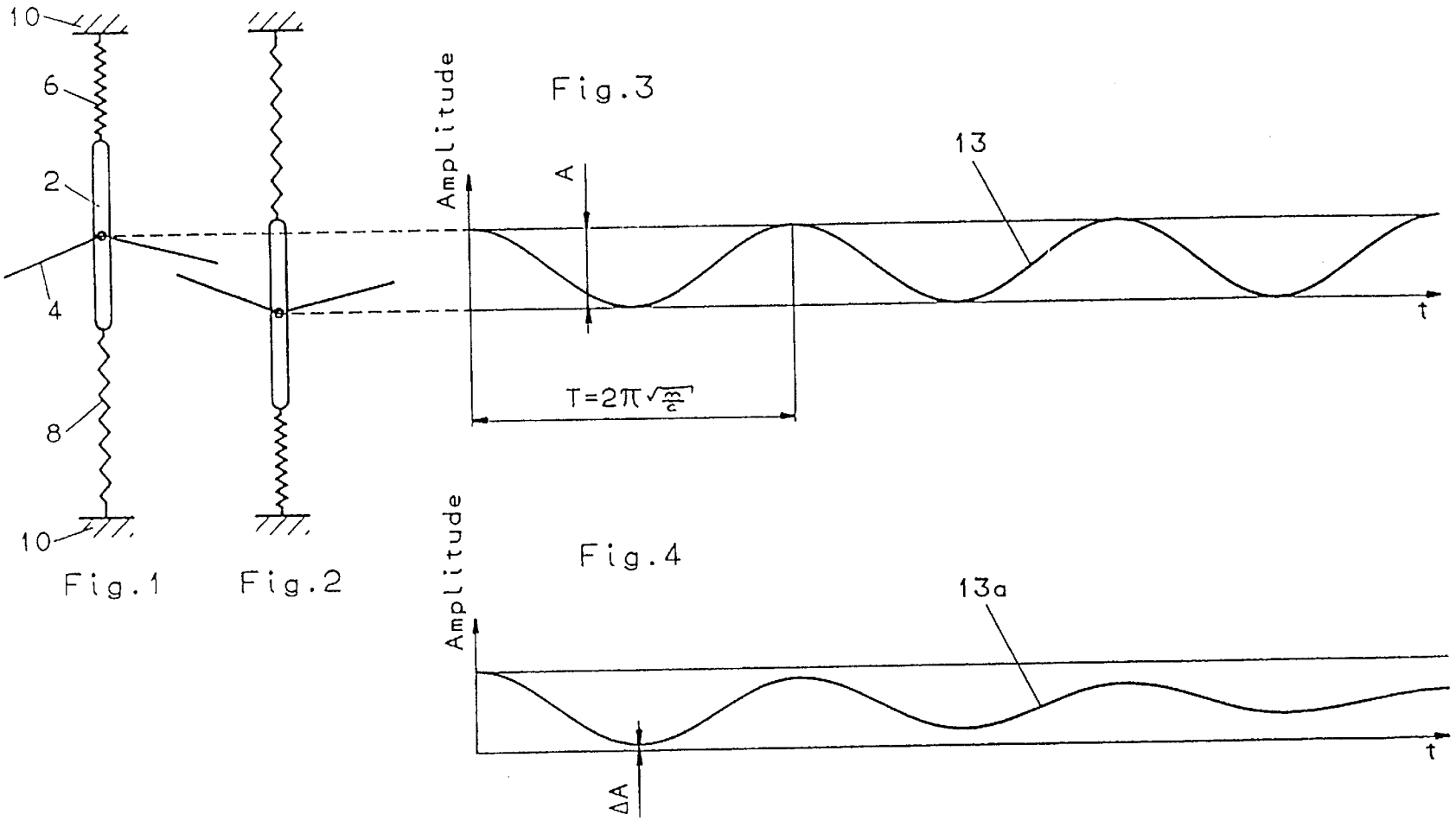
FIG. 1 shows the oscillating system of a device according to the invention disclosed hereunder in the raised position.
FIG. 2 shows the oscillating system illustrated in FIG. 1 in the lowered position.
FIG. 3 shows the theoretical ideal sequence of oscillations of the oscillation system illustrated in FIG. 1 and FIG. 2.
FIG. 4 shows the actual sequence of oscillations of the oscillation system illustrated in FIG. 1 and FIG. 2.

FIG. 1 and FIG. 2 as well as diagrams 3 and 4 illustrate the principle underlying the invention disclosed hereunder, i.e. an oscillating system consisting of a dragging element 2 for the transverse movement of a thread 4, the dragging element 2 being attached to a machine frame 10 by means of an upper spring 6 and a lower spring 8. In the ideal case, the oscillation system would, according to curve 13 in FIG. 3, continue to oscillate indefinitely at the natural frequency f (oscillations/second):

$$f = \frac{1}{2\pi}\sqrt{\frac{c}{m}}$$

where:

m=mass of the oscillating system, whereby also the mass of the spring and the mass of the threads to be moved must be taken into account.

c=spring constant of the oscillating system, taking into account not only the upper spring 6 and the lower spring 8, but also the restoring force caused by the transverse movement of the thread 4.

In the ideal case—which, however, doesn't exist—the oscillating system would oscillate according to curve 13 illustrated in FIG. 3, the amplitude A being a full oscillation during time T:

$$T = 2\pi\sqrt{\frac{m}{c}}$$

This ideal case doesn't occur in real life. Instead, friction, work of deformation, etc. consume the oscillation energy, so that the oscillating system oscillates according to curve 13*a* illustrated in FIG. 4, the amplitude decreasing from one oscillation to the next by ΔA. To keep the system moving, it is therefore necessary to continuously supply a smaller or larger quantity of energy.

Figures 5, 6, 7:
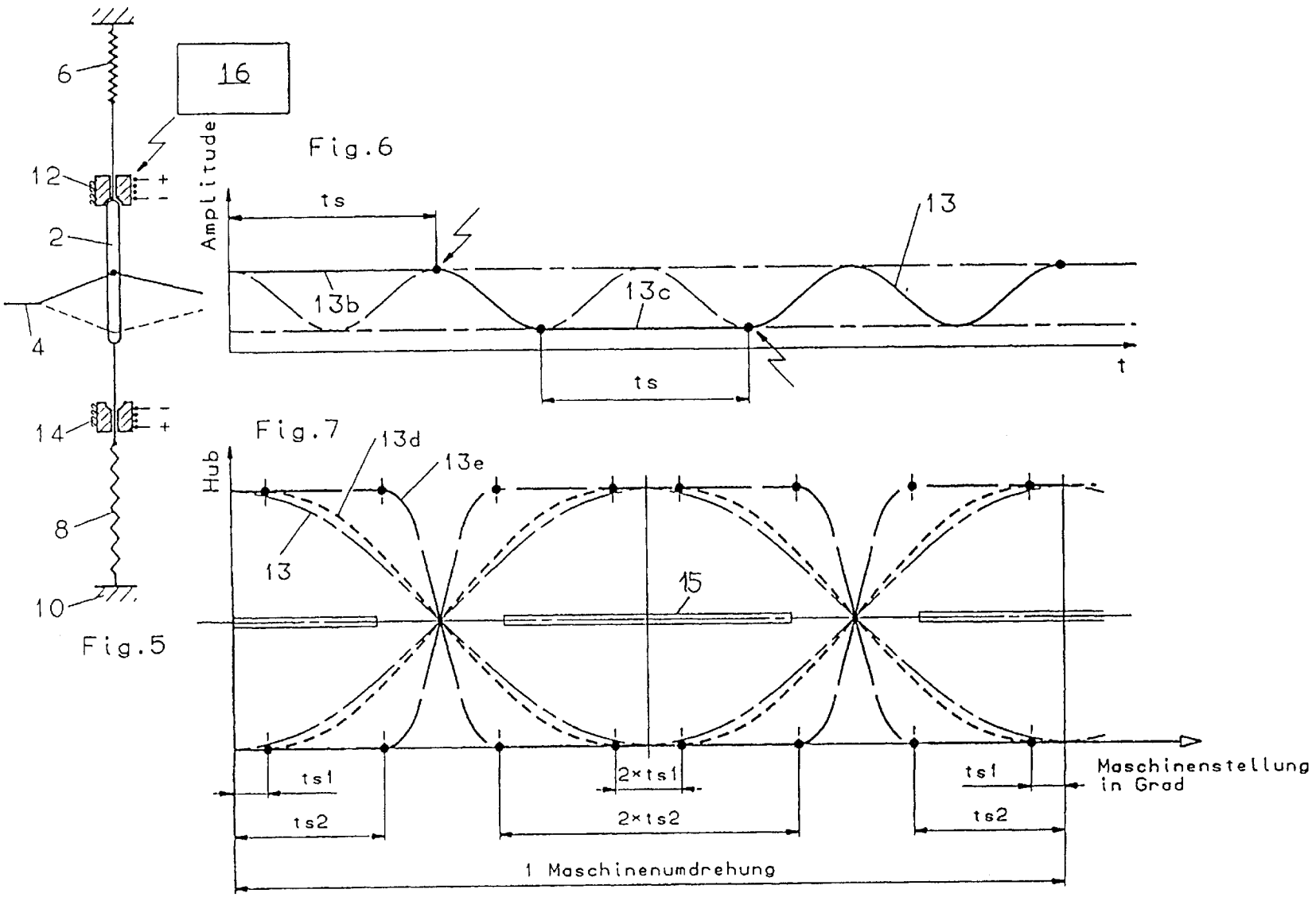
FIG. 5 shows the oscillating system illustrated in FIG. 1 and FIG. 2 including arresting devices in the extreme positions.
FIG. 6 shows a controlled sequence of oscillations of the oscillation system illustrated in FIG. 5.
FIG. 7 shows the curve of the oscillating system depending on the rotational position of the machine connected thereto at different rotational speeds.

FIG. 5 and diagram 6 show the oscillating system of FIG. 1 and FIG. 2, the device, however, being supplemented by an upper arresting device 12 and a lower arresting device 14, which are designed as electromagnetic units and can be controlled by a control unit 16. The arresting devices 12 and 14 deflect the oscillating dragging element 2 during each oscillation into the extreme position determined by the amplitude A. Thereby, the arresting devices 12 and 14 serve both to supply energy, as they make up for the reduction of the oscillation by ΔA, and to control the oscillating system. Thus the dragging element can for an adjustable period ts, for example for a full oscillation, be kept in the upper or lower position as this is illustrated by curve sections 13*b* and 13*c* of curve 13 in FIG. 6. Thus, the transverse movement of the thread 4 can be individually controlled in the way required, for example, for the production of patterned fabrics on a weaving loom.

FIG. 7 shows the curve travelled by the device during one rotation of the main shaft of a weaving loom at different rotational speeds π (rotations/second). Curve 13 shows the borderline case where the rotational speed of the weaving loom equals the frequency of the oscillating system. When the weaving loom works more slowly, the oscillating system must be stopped at periodic intervals so as to synchronise the oscillating system with the rotational speed of the weaving loom. Curve 13*d* shows the situation that prevails in the case of fast operating weaving looms where the arresting time per half oscillation is 2×ts1. The arresting time increases when the rotational speed of the weaving loom is reduced and amounts, for example in curve 13*e* where the situation prevailing when the weaving loom works more slowly is illustrated, to 2×ts2. FIG. 7 also indicates the area 15 available for weft insertion.

Figures 8, 9, 10, 11:
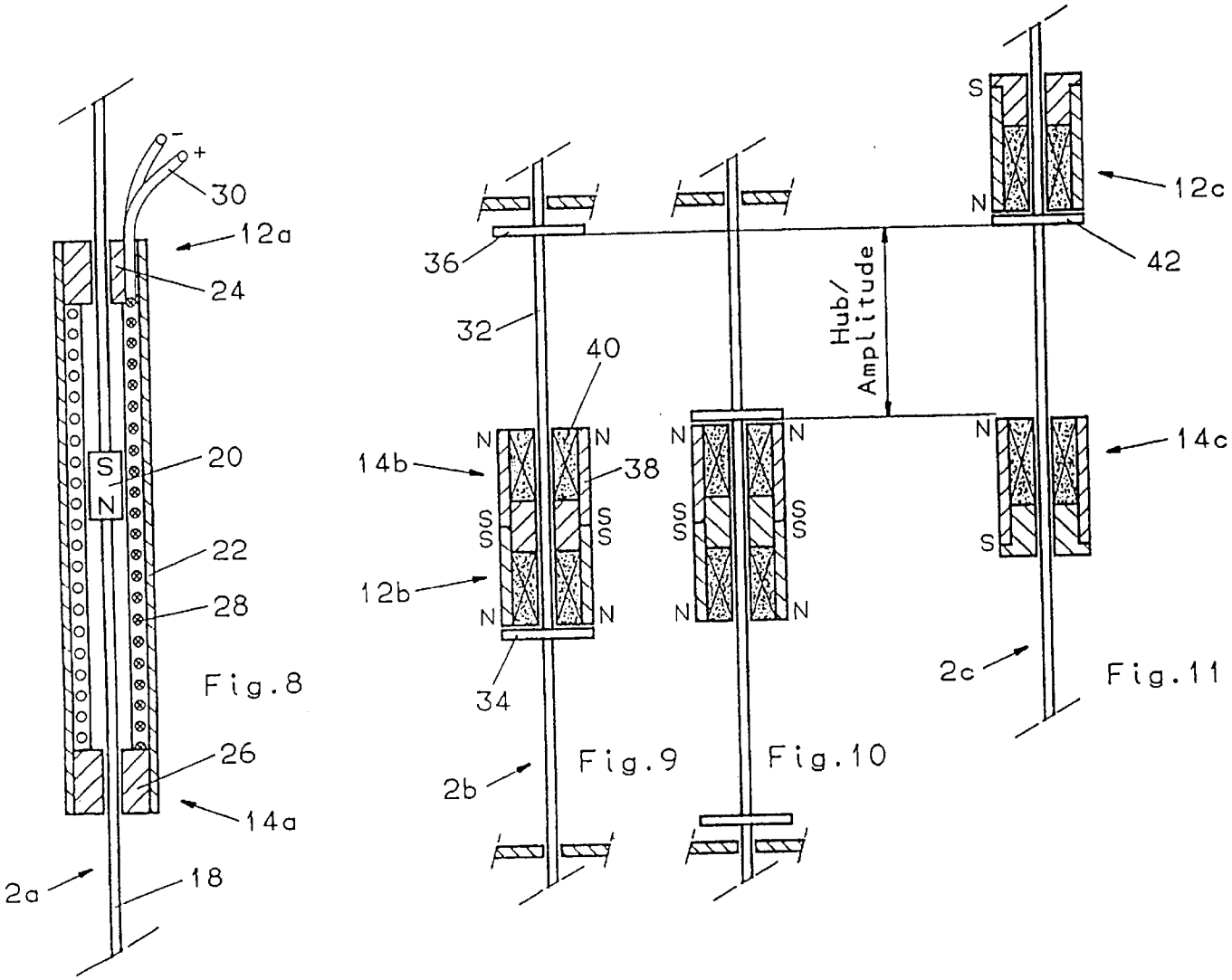
FIG. 8 shows a vertical section of a combination of an arresting device and an energy supplying mechanism.
FIG. 9 and FIG. 10 show a vertical section of another arresting device in the two extreme positions.
FIG. 11 shows a vertical section of yet another arresting device.

FIG. 8 shows another design of the device for the transverse movement of a thread. In this case, the dragging element 2*a* is provided with a rod 18 on which a piston-shaped element 20 is mounted which consists of a permanent magnet. This piston-shaped element moves within a cylinder 22 which is provided with a ferromagnetic terminal section 24 and 26 at the upper and lower end against which element 20 is arrested in the upper or lower extreme position, respectively. Cylinder 22 contains a coil 28, which is connected with the control unit 16 via wires 30. Depending on the activation of the coil 28, this device performs different tasks. On the one hand, the coil can be used to release element 20 from the ferromagnetic terminal section 24 or 26 so as to trigger the oscillating movement. On the other hand, the coil 28 can be activated in such a way that it supports the movement of the element 20 and, thus, the movement of the dragging element 2*a* against the terminal section 24 or 26, respectively. In this case, coil 28 serves to supply the oscillating system with energy. The system can be designed in such a way that the cylinder 22 extends over the entire travelling distance of the dragging element 2*a*. It is, however, also possible to divide the cylinder 22 and to limit it, as shown in FIG. 11, to the extreme positions of the oscillating system. Instead of the coil, the cylinder can also be connected to a hydraulic fluid system, which can serve to provide a controlled energy supply.

FIG. 9 and FIG. 10 show another dragging element 2*b* which is provided with a rod 32 on which two piston-shaped elements 34 and 36 are mounted between arresting devices 12*b* and 14*b* which are mounted in block-type arrangement. In this case the arresting device 12*b*, which marks the upper extreme position and to which the piston-shaped element 34 adheres, is located at the bottom and the arresting device 14*b*, which marks the lower extreme position and to which element 36 adheres, at the top. The arresting devices 12*b* and 14*b* consist of permanently magnetic rings 38 arranged in such a way that their identical poles are facing each other. Within each ring 38, there are electromagnets 40, which can be operated by the above-mentioned control unit 16. As soon as the extreme position is reached, the piston-shaped elements 34 and 36 adhere to the respective arresting devices 12*b* and 14*b* and are released only upon activation of the electromagnets 40 to perform another oscillating movement.

FIG. 11 shows the device illustrated in FIG. 9 and FIG. 10, the arresting devices 12*c* and 14*c*, however, being arranged at a distance from each other which defines the travelling distance and the dragging element 2*c* being provided with only one piston-shaped element 42 which moves between the two arresting devices 12*c* and 14*c*.

Figures 12, 13:
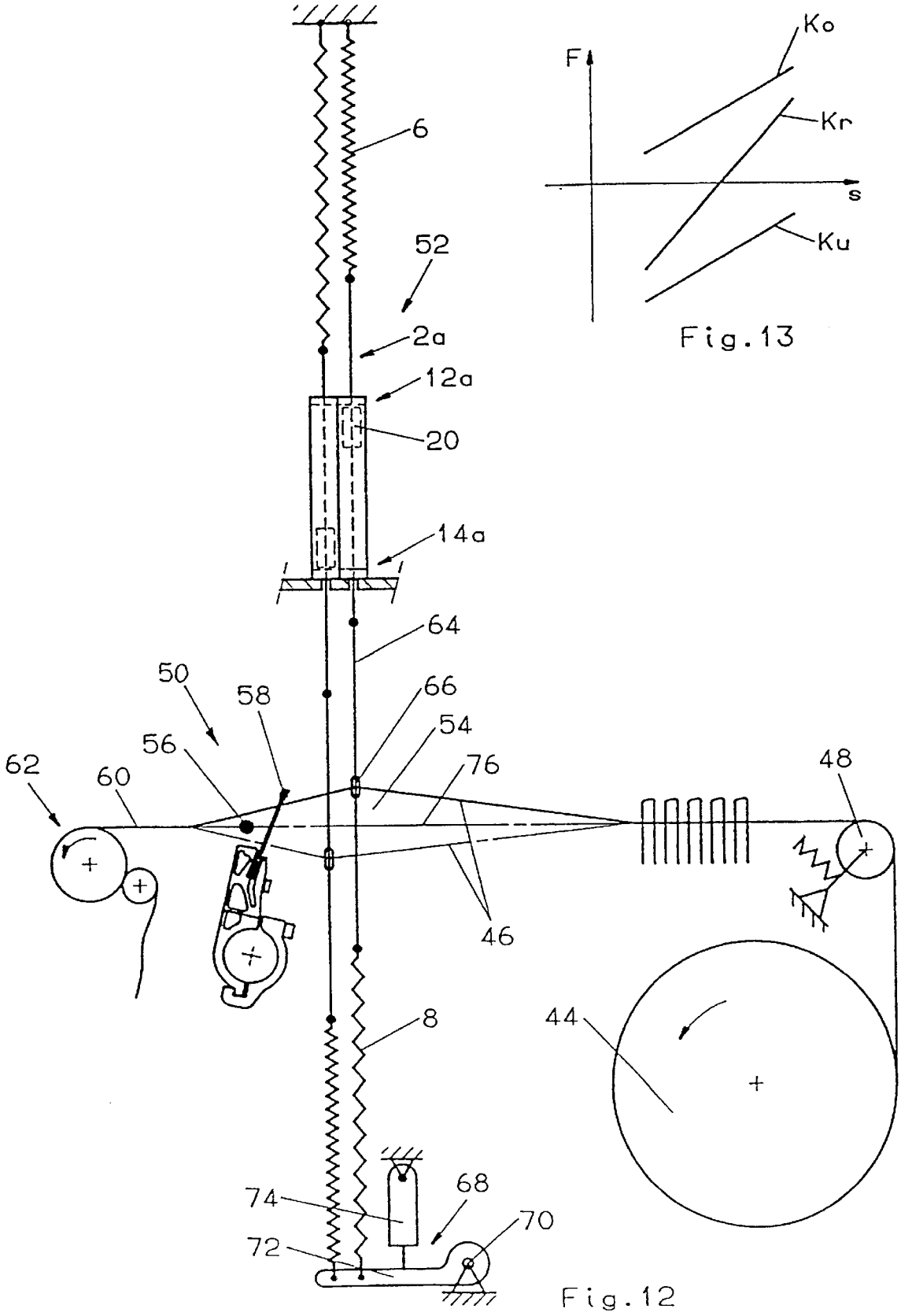
FIG. 12 shows a schematic illustration of a weaving loom equipped with the device disclosed hereunder.
FIG. 13 shows the load characteristic of the upper and the lower spring of the device illustrated in FIG. 12 during half an oscillation cycle.

FIG. 12 contains a schematic illustration of a weaving loom provided with the devices disclosed hereunder. The weaving loom contains a warp beam 44 around which warp threads 46 are wound and which are fed over a guide roller 48 to the weaving site 50. The devices 52 disclosed hereunder are used to control the warp threads 46 and to create the shed 54 into which weft threads 56 are inserted and arrested by means of a weaving reed 58. The resulting fabric 60 is removed via an outfeed unit 62. The control unit 52 contains a dragging element 2*a* and an arresting device 12*a* and 14*a* according to FIG. 8. The dragging element 2*a* is provided with a heddle 64, which contains an eye 66 for the dragging of a warp thread 46. The control unit 52 is, additionally, provided with a resetting device 68 which comprises an arm 72 which swivels around axle 70 and to which the lower end of the respective lower spring 8 is attached. An actuator 74 can move the swivelling arm upwards, thus relieving the springs 8. The resetting device 68 is used to take the control unit 52 back into the initial position required to put the system into operation in which the piston-shaped element 20 adheres to the respective arresting device 12*a* or 14*a*, should a reset be required for any reason, e.g. after adjustment or repair work. Such a situation exists, for example, when the eyes are located in the centre shed 76. Then the lower springs 8 are relieved upon operation of the actuator 74 whereupon the spring force of the upper springs 6 prevails so that the piston-shaped elements 20 can be moved towards and adhere to their respective upper arresting devices 12*a*.

FIG. 13 shows the spring force characteristics of the springs 6 and 8, Ko referring to the upper spring 6 and Ku to the lower spring 8, Kr being the force characteristics resulting for the dragging element 2*a*. This illustration shows that no force acts upon the dragging element when the dragging element 2*a* is located in the centre shed 76, which means that a resetting device 68 is needed to take the dragging element 2*a* back to one of the arresting devices.

FIG. 14 shows a schematic illustration of another weaving loom designed in analogy to the weaving loom shown in FIG. 12 but provided with arresting devices 12*c* and 14*c* according to FIG. 11. FIG. 15 contains a schematic illustration of the equipment of a weaving loom with the arresting devices 12*b* and 14*b* according to FIG. 9 and FIG. 10.

FIG. 16 shows the weaving loom schematically illustrated in FIG. 14, the eye 78 for the dragging of the warp thread 46, however, not being located within, i.e. between the upper and the lower spring 6 and 8 but outside. For this purpose, the dragging element 2*d* is designed in the form of a rod which is extended upward through the upper spring 6 and provided with the eye 78 in this extended section.

In the designs presented, the thread-dragging element is usually illustrated as an eye for the dragging of a single thread. The arrangement, however, can also be designed in such a way that the dragging element is, instead of an eye, connected to a known heddle frame design which can be used to control several threads at the same time.

Due to the elimination of the state of the art connecting elements and the known upstream shedding machines, the device disclosed hereunder can, for example, be used to achieve the following significant characteristics or advantages, respectively:

Significantly reduced space consumption. Thus the workplace can be optimally designed.

The top of the machine need not be provided with additional structures. This offers the advantage of an optimal view over the entire machine and better handling.

Small forces of inertia as fewer parts are moving. Therefore, higher rotational speeds are possible.

Small number of wearing points and practically no vibrations. This allows a high reduction of the noise emission level.

Dramatic reduction of the danger of accidents due to fewer critical moving parts.

Simple maintenance due to simple parts and few components.

The workplace can be optimally equipped from an ergonomic point of view.

The cost of the device disclosed hereunder is extremely low, as no expensive additional components are required. Economically viable textile production is possible both in high and in low wage countries.

No harness, no beams and utilisation of the oscillation energy. Thus enormous energy savings are possible. Energy is only supplied to make up for friction losses.

No force from spring restoring devices and no forces of inertia due to acceleration of the connecting elements.

LIST OF REFERENCES

| | |
|---|---|
| A | amplitude |
| ΔA | lost share of the amplitude |
| T | duration |
| Ts | arresting time |
| ts1 | arresting time at fast operation |
| ts2 | arresting time at slow operation |
| 2 | dragging element |
| 2a | dragging element |
| 2b | dragging element |
| 2c | dragging element |
| 2d | dragging element |
| 4 | thread |
| 6 | spring, upper |
| 7 | spring, lower |
| 10 | machine frame |

-continued

| LIST OF REFERENCES | |
|---|---|
| 12 | arresting device, upper |
| 12a | arresting device, upper |
| 12b | arresting device, upper |
| 12c | arresting device, upper |
| 13 | oscillation curve (ideal) |
| 13a | oscillation curve (actual) |
| 13b | curve section, upper |
| 13c | curve section, lower |
| 13d | oscillation curve, fast operation |
| 13e | oscillation curve, slow operation |
| 14 | arresting device, lower |
| 14a | arresting device, lower |
| 14b | arresting device, lower |
| 14c | arresting device, lower |
| 15 | weft insertion area |
| 16 | control unit |
| 18 | rod |
| 20 | piston-shaped element |
| 22 | cylinder |
| 24 | ferromagnetic terminal section |
| 26 | ferromagnetic terminal section |
| 28 | coil |
| 30 | wire |
| 32 | rod |
| 34 | piston-shaped element |
| 36 | piston-shaped element |
| 38 | ring |
| 40 | electromagnets |
| 42 | piston-shaped element |
| 44 | warp beam |
| 46 | warp thread |
| 48 | deflection roller |
| 50 | weaving site |
| 52 | control unit |
| 54 | shed |
| 56 | weft thread |
| 58 | weaving reed |
| 60 | fabric |
| 62 | outfeed unit |
| 64 | heddle |
| 66 | eye |
| 68 | resetting device |
| 70 | axle |
| 72 | arm |
| 74 | actuator |
| 76 | centre shed |
| 78 | eye |

What is claimed is:

1. Device for controlling the transverse movement of at least one thread of a textile machine, especially a warp thread in a weaving loom, with a dragging element mounted between two springs which is used to draft at least one thread, and an arresting device which can be controlled by means of a control unit and is used to temporarily arrest the dragging element in at least one extreme position, characterised by the fact that the springs and the dragging element are designed as a freely oscillating system which can be temporality arrested for an adjustable period of time by means of the arresting device and oscillates at a natural frequency f:

$$f = \frac{1}{2\pi}\sqrt{\frac{c}{m}}$$

where m=oscillating mass and c=spring constant.

2. Device according to claim 1, characterised by the fact that the arresting device (12, 12*a*, 12*b*, 12*c*, 14, 14*a*, 14*b*, 14*c*) can be controlled by means of the control unit (16) in such a way that the dragging element (2, 2*a*, 2*b*, 2*c*, 2*d*) can be arrested in an extreme position for at least the duration (ts) of one full oscillation.

3. Device according to claim 1, characterised by the fact that the arresting device (12, 12*a*, 12*b*, 12*c*, 14, 14*a*, 14*b*, 14*c*) can be controlled by means of the control unit (16) in such a way that the dragging element (2, 2*a*, 2*b*, 2*c*, 2*d*) can be arrested in the upper and/or lower extreme position for an adjustable period of time (ts, ts1, ts2).

4. Device according to claim 1, charcterised by the fact that the arresting device is provided with a releasable magnetic device allocated to the upper and/or lower extreme position of the dragging element and located between the latter and a machine frame.

5. Device according to claim 4, characterised by the fact that the magnetic device comprises a permanent magnet (20, 38) which can be influenced by means of an electromagnet (28, 40) allocated thereto and connected with the control unit.

6. Device according to claim 1, characterised by the fact that it comprises means to supply the oscillating system with energy.

7. Device according to claim 1, characterised by the fact that the dragging element is provided with a piston-shaped element which is permanently magnetic or ferromagnetic and interacts with a fixed location ferromagnetic or permanently magnetic counterpiece.

8. Device according to claim 7, characterised by the fact that the piston-shaped element (20) moves in a cylinder (22) which is provided with means (28) to supply energy.

9. Device according to claim 8, characterised by the fact that the means (28) to supply energy consists of a hydraulic fluid which can be alternatively transported to either side of the piston-shaped element (20).

10. Device according to claim 8, characterised by the fact that the cylinder (22) is provided with an electric coil (28) which is located along the cylinder wall.

11. Device according to claim 1, characterised by the fact that it is provided with an resetting device to temporarily relieve the springs at one end of the dragging element in such a way that the dragging element can be moved, upon actuation of the springs, towards the arresting device opposite from the resetting device.

12. Device according to claim 11, characterised by the fact that the resetting device (68) is provided with a swivelling arm (72) to which the respective spring (8) of one side of the oscillating system is attached and which can be swivelled against the other side of the oscillating system.

13. Device according to claim 1, characterised by the fact that the dragging element is provided with at least one thread dragging element between the springs.

14. Device according to claim 1, characterised by the fact that the dragging element located between the springs is extended on one end and led to a thread dragging element by a spring.

15. Device according to claim 1, characterised by the fact that the dragging element is provided with an eye to drag one thread.

16. Device according to claim 1, characterised by the fact that the dragging element is provided with a device allowing to drag several threads at the same time.

17. Device according to claim 1 characterised in that the dragging element is provided with a heddle frame allowing several threads to be dragged at the same time.

* * * * *

UNITED STATES PATENT AND TRADEMARK OFFICE

CERTIFICATE OF CORRECTION

PATENT NO. : 6,079,455
DATED : June 27, 2000
INVENTOR(S) : Francisco Speich et al.

It is certified that error appears in the above-identified patent and that said Letters Patent is hereby corrected as shown below:

Claim 1,
Lines 2-3, delete "especially a warp thread in a weaving loom,";
Line 4, after "springs", replace "which is used to draft" with -- for drawing --;
Lines 5-6, after "device", delete "which can be controlled by means of a control unit and is used to" and insert -- controllable by a control unit and for --;
Line 6, after "temporarily", replace "arrest" with -- arresting --;
Line 9, delete "designed as";
Lines 9-10, after "system", replace "which can be temporality arrested" with -- which is designed for temporarily arresting the dragging element --; and
Line 11, replace "oscillates" with -- oscillating --.

Claim 2,
Lines 2-3, replace "(12, 12a, 12b, 12c, 14, 14a, 14b, 14c) can be" with -- is --;
Line 3, after "controlled by", delete "means of";
Lines 4-5, after "element", replace "(2, 2a, 2b, 2c, 2d) can be" with -- is --.

Claim 3,
Lines 2-3, after "device", replace "(12, 12a, 12b, 12c, 14, 14a, 14b, 14c) can be" with "is";
Line 3, after "controlled by", delete "means of";
Line 3, delete "(16)";
Line 4, after "element" delete "(2, 2a, 2b, 2c, 2d)";
Line 5, before "upper", replace "the" with -- an --;
Line 5, replace "and/or" with -- or --;
Line 5, after "position", insert -- or combination thereof --;
Line 6, delete "(ts, ts 1, ts2)".

Claim 4,
Line 1, replace "charcterised" with -- characterised --;
Line 3, before "upper" replace "the" with -- an --;
Line 3, replace "and/or" with -- or --;
Line 4, after "element", insert -- or combination thereof --;
Line 5, replace "latter" with -- extreme positions --.

Claim 5,
Lines 2-3, please delete "(20, 38)";
Line 3, please replace "can be" with -- is --;
Line 4, please delete "(28, 40)".

UNITED STATES PATENT AND TRADEMARK OFFICE

CERTIFICATE OF CORRECTION

PATENT NO. : 6,079,455
DATED : June 27, 2000
INVENTOR(S) : Francisco Speich et al.

It is certified that error appears in the above-identified patent and that said Letters Patent is hereby corrected as shown below:

Claim 6,
Line 2, prior to "comprises", please replace "it" with -- said device --.

Claim 8,
Line 2, please delete "(20)" and "22)";
Line 3, please delete "(28)".

Claim 9,
Line 2, please delete "(28)";
Line 3, please replace "can be" with -- is --;
Line 4, please delete "(20)".

Claim 10,
Line 2, please delete "(22)" and "(28)".

Claim 11,
Line 2, please replace "it" with -- said device --.

Claim 12,
Line 2, please delete "(68)";
Line 3, please delete "(72)" and "(8)";
Line 4, please replace "can be" with -- is --.

Signed and Sealed this

Fourth Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,079,455
DATED : June 27, 2000
INVENTOR(S) : Francisco Speich et al.

It is certified that error appears in the above-identified patent and that said Letters Patent is hereby corrected as shown below:

Claim 16,
Lines 2-3, please replace "allowing to drag" with -- for dragging --.

Claim 17,
Lines 2-3, please replace "allowing several threads to be dragged" with -- for dragging several threads --.

Signed and Sealed this

Fourth Day of December, 2001

*Attest:*

Nicholas P. Godici

*Attesting Officer*

NICHOLAS P. GODICI
*Acting Director of the United States Patent and Trademark Office*